US005353759A

United States Patent [19]

Abe et al.

[11] Patent Number: 5,353,759

[45] Date of Patent: Oct. 11, 1994

[54] CRANK CHAMBER COMPRESSION TYPE TWO CYCLE ENGINE

[75] Inventors: Koji Abe; Kimihiro Nonaka; Osamu Nagabora, all of Hamamatsu, Japan

[73] Assignee: Sanshin Kogyo Kabushiki Kaisha, Hamamatsu, Japan

[21] Appl. No.: 33,871

[22] Filed: Mar. 19, 1993

[30] Foreign Application Priority Data

Mar. 19, 1992 [JP] Japan ..... 4-093459

[51] Int. Cl.[5] ..... F02N 17/00; F02M 1/10

[52] U.S. Cl. ..... 123/179.15; 123/196 S; 123/196 M

[58] Field of Search ..... 123/73 AD, 73 C, 73 CB, 123/196 M, 179.7, 179.8, 179.9, 179.15, 196 S

[56] References Cited

U.S. PATENT DOCUMENTS

| | | | |
|---|---|---|---|
| 1,970,088 | 8/1934 | Graves | 123/179.8 |
| 2,601,562 | 6/1952 | Schoeppner et al. | 123/179.9 |
| 2,740,385 | 4/1956 | Haage | 123/179.8 |
| 3,161,184 | 12/1964 | Koftan | 123/179.8 |
| 3,800,754 | 4/1974 | Carlson et al. | 123/73 CB |
| 3,985,113 | 10/1976 | Du Bois et al. | 123/179.9 |
| 4,280,455 | 7/1981 | Yamaguchi et al. | 123/196 M |
| 4,462,346 | 7/1984 | Haman et al. | 123/179.9 |
| 4,627,390 | 12/1986 | Antoine | 123/73 CB |
| 4,660,516 | 4/1987 | Baltz et al. | 123/179.9 |
| 4,774,916 | 10/1988 | Smith | 123/179.8 |
| 4,779,581 | 10/1988 | Maier | 123/73 AD |
| 4,794,896 | 1/1989 | Tsai et al. | 723/196 M |
| 4,870,932 | 10/1989 | Asmus | 123/179.15 |
| 4,998,969 | 3/1991 | Bowers et al. | 123/179.9 |
| 5,002,025 | 3/1991 | Crouse | 123/196 M |
| 5,031,590 | 7/1991 | Sakurai | 123/179.9 |

FOREIGN PATENT DOCUMENTS 3260311 11/1991 Japan .

*Primary Examiner*—E. Rollins Cross
*Assistant Examiner*—Thomas N. Moulis
*Attorney, Agent, or Firm*—Knobbe, Martens, Olson & Bear

[57] ABSTRACT

A crankcase compression, two cycle, internal combustion engine including an arrangement for facilitating starting by reducing the viscosity of lubricant which may remain on the cylinder bore after engine shut down. This viscosity decrease is accomplished by adding a low viscosity fluid through the cylinder bore during starting if the temperature of the engine is below a predetermined amount.

24 Claims, 5 Drawing Sheets

CRANK CHAMBER COMPRESSION TYPE TWO CYCLE ENGINE

BACKGROUND OF THE INVENTION

This invention relates to a two cycle engine and more particularly to an improved arrangement for assisting in the starting of two cycle engines.

As is well know, two cycle engines are normally lubricated by introducing lubricant to the engine at least in part through its induction system, particularly when the engine is of the crankcase compression type. The lubricant is circulated through the engine along with the intake charge and this lubricant may be either supplied as mixed with the fuel or from a separate lubricating system. Although this type of system is extremely effective, there are some disadvantages.

Specifically, when the engine is shut off, there will be some lubricant that remains on the wall of the cylinder. Although this is desirable to insure adequate lubrication upon restarting, if the engine temperature is high at the time the engine is shut off or becomes elevated after it shuts off, the lubricant may be partially carbonized. In addition, if this does not occur, the lubricant may become mixed with combustion products that also remain on the cylinder walls and the viscosity of the lubricant can increase.

If such increased viscosity lubricant remains on the cylinder walls and the engine is next started, the increased viscosity of the lubricant will give rise to high cranking loads and result in low cranking speeds. This is obviously undesirable.

It is, therefore, a principal object to this invention to provide an improved system for facilitating the starting of a two cycle engine.

It is a further object to this invention to provide an arrangement for facilitating the starting of an engine if lubricant remaining on the cylinder walls will have attained a higher than desired viscosity.

It is a further object to this invention to provide an improved arrangement which will reduce the viscosity of lubricant on the cylinder walls during starting after periods of inactivity and if the temperature is below a predetermined amount.

SUMMARY OF THE INVENTION

This invention is adapted to be embodied in a system and method for facilitating the starting of an internal combustion engine, which engine is comprised of a cylinder bore and piston reciprocating in the cylinder bore. A port is provided that communicates with the bore in an area swept by the piston. Means are provided for starting the engine and also means are provided for sensing the temperature.

In accordance with the apparatus embodying the invention, means supply a low viscosity fluid to the port upon the starting of the engine when the temperature sensed is below a predetermined value.

In accordance with a method practicing the invention, a low viscosity fluid is supplied to the port when the engine is being started and if the temperature is below a predetermined value.

DETAILED DESCRIPTION OF THE PREFERRED EMBODIMENTS OF THE INVENTION

Figure 1:
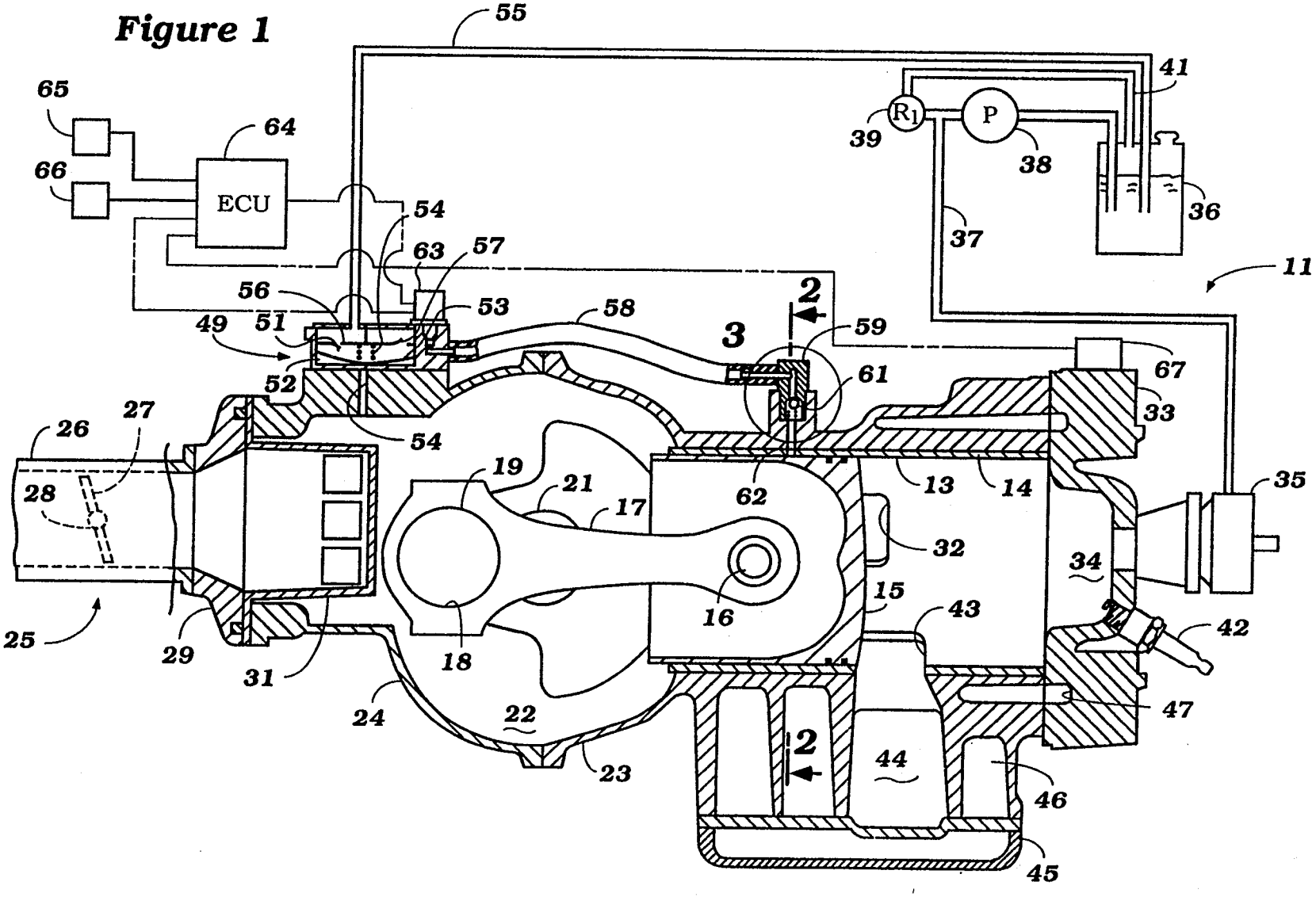
FIG. 1 is a partially schematic cross sectional view taken through a single cylinder of a multiple cylinder, two cycle, crankcase compression engine constructed in accordance with an embodiment of the invention.
Figure 2:
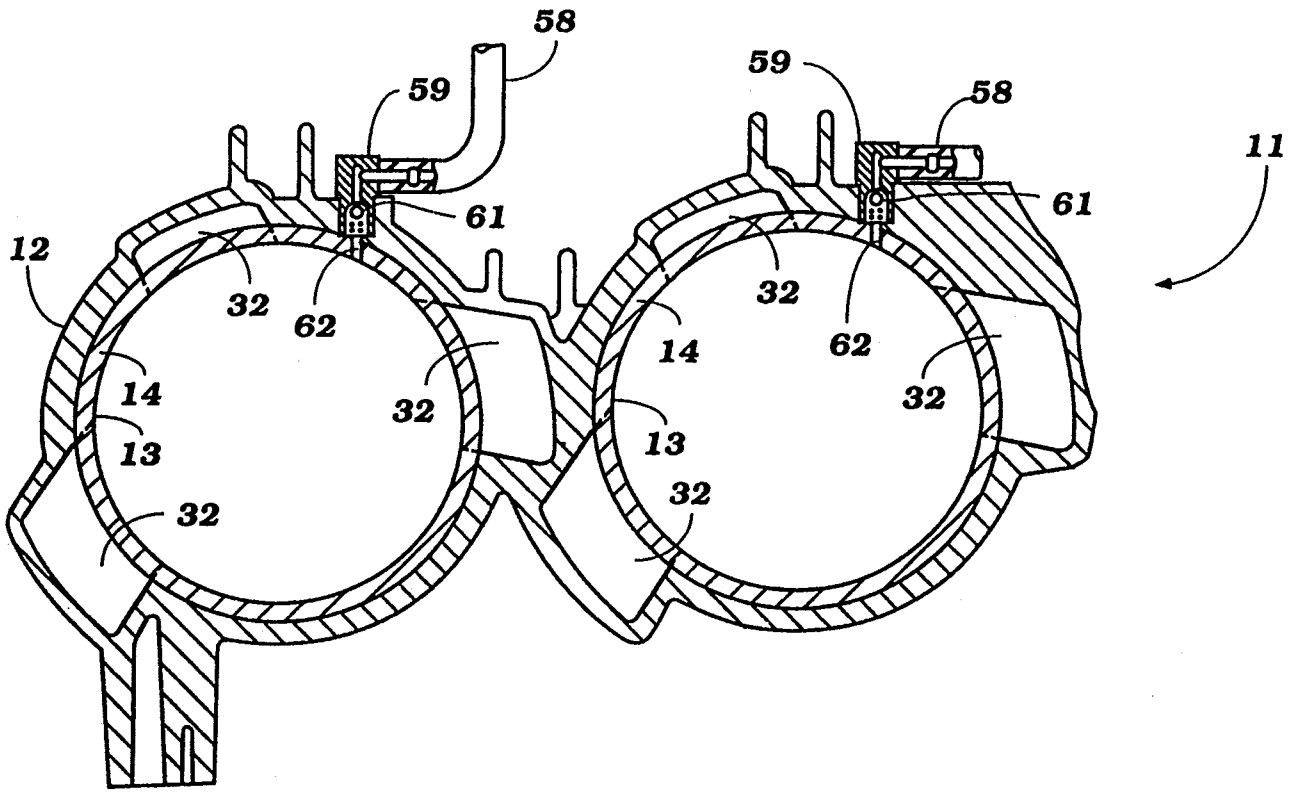
FIG. 2 is a cross sectional view taken along the line 2—2 of FIG. 1.

Referring now in detail to the drawings and initially to the embodiment of FIGS. 1 through 4, a two cycle, crankcase compression, internal combustion engine constructed and operated in accordance with an embodiment of this invention is identified generally by the reference numeral 11. In the illustrated embodiment, the engine 11 is of the two cylinder, inline type and operates on a crankcase compression principal. It is to be understood that this invention can be practiced with engines having other cylinder numbers and other cylinder configurations and, in fact, in conjunction with rotary type engines. Also, certain facets of the invention may be utilized with other that two cycle engines, however, the invention has particular utility in conjunction with such engines, for reasons which will become apparent.

The engine 11 includes a cylinder block 12 which, in the illustrated embodiment, is provided with two inline cylinder bores 13 formed by pressed or cast-in liners 14. In the illustrated embodiment, the cylinder bores 13 extend horizontally, as is typical in many types of two cycle engine applications, for example when employed in conjunction with an outboard motor.

Pistons 15 are slidably supported in each of the cylinder bores 13 and are connected by means of piston pins 16 to respective connecting rods 17. The connecting rods 17 have their large ends 18 journalled on the respective throws 19 of a crankshaft 21. The crankshaft 21 is rotatably journalled within a crankcase chamber 22 formed by a skirt 23 of the cylinder block 12 and a crankcase member 24 that is affixed to the skirt 23 in a known manner. As is typical with two cycle, crankcase compression engines, the crankcase chamber 22 associated with each cylinder bore 13 is sealed from the other.

An air charge is delivered to the crankcase chambers 22 by means of an induction system, indicated generally by the reference numeral 25 which includes an air inlet device 26 in which a flow controlling throttle valve 27 is supported on a throttle valve shaft 28. As is typical with two cycle practice, there may be provided a single throttle valve 27 for each crankcase chamber 22 of the engine.

The air inlet device 26 communicates with the crankcase chambers 22 through an intake manifold 29 in which a reed type valve assembly 31 is provided so as to permit an air charge to flow into the crankcase chambers 22 when the pistons 15 move upwardly within the cylinder bores 13 and which will close to permit compression of the charge as the pistons 15 move downwardly within the bores 13.

A plurality of scavenge passages (three in the illustrated embodiment) indicated by the reference numeral 32 extend from the crankcase chambers 22 and open into the cylinder bores 13 at circumferentially spaced locations. The scavenge passages 32 are configured so as to provide a shnurle type of scavenging, although it should be readily apparent to those skilled in the art that the type of scavenging employed with the engine can vary without departing from the spirit and scope of the invention. The scavenge passages 32 are opened and closed by the reciprocation of the pistons 15, as is well known in this art.

A cylinder head assembly 33 is affixed to the cylinder block 12 in a suitable manner and has individual recesses 34 which cooperate with the cylinder bores 13 and pistons 15 to form the combustion chambers of the engine.

In the illustrated embodiment, the engine 11 is depicted as being of the direct cylinder injected type and to this end there is provided a fuel injector 35 mounted in the cylinder head 33 for each combustion chamber 34. Fuel is supplied to the fuel injector 35 from a remotely positioned fuel tank 36 through a conduit 37 in which a high pressure pump 38 is provided. The pressure of the fuel delivered to the fuel injectors 35 is regulated by a pressure regulator 39 by dumping excess fuel back to the fuel tank 36 through a return conduit 41.

The fuel injector 35 may be of any known type and may be electronically operated to spray fuel into the combustion chamber 34 at the appropriate time. A fuel-/air charge which is then formed with the compressed air that has been transferred through the scavenge passages 32 is fired by a spark plug 42 mounted in the cylinder head 33 for each combustion chamber 34. The spark plugs 41 are fired by any suitable ignition circuit.

As the charge burns and expands, the pistons 15 will be driven downwardly and eventually an exhaust port 43 will be opened and the exhaust gases can flow into an exhaust manifold 44 formed internally in the cylinder block 12 and which is closed by a closure plate 45. The exhaust gases are then discharged from the exhaust manifold 44 to the atmosphere through any known type of exhaust system. In an outboard motor application, this exhaust system will include an underwater high speed exhaust gas discharge as well as an above-the-water low speed exhaust gas discharge.

The engine 11 is water cooled and to this end, there is provided a cooling jacket 46 for the cylinder block 12 around the cylinder bores 13 and a further cooling jacket 47 in the cylinder head 33 around the combustion chambers 34. Water is circulated through the cooling jacket in any well known manner.

The construction of the engine 11 as thus far described, may be considered to be conventional and the invention deals with the arrangement for facilitating starting of the engine. The engine 11 is provided with a suitable lubrication system which will supply lubricant to the engine through the induction system 25 which lubricant then can lubricant the crankshaft 21, connecting rods journals 18 and pistons 15.

Figure 3:
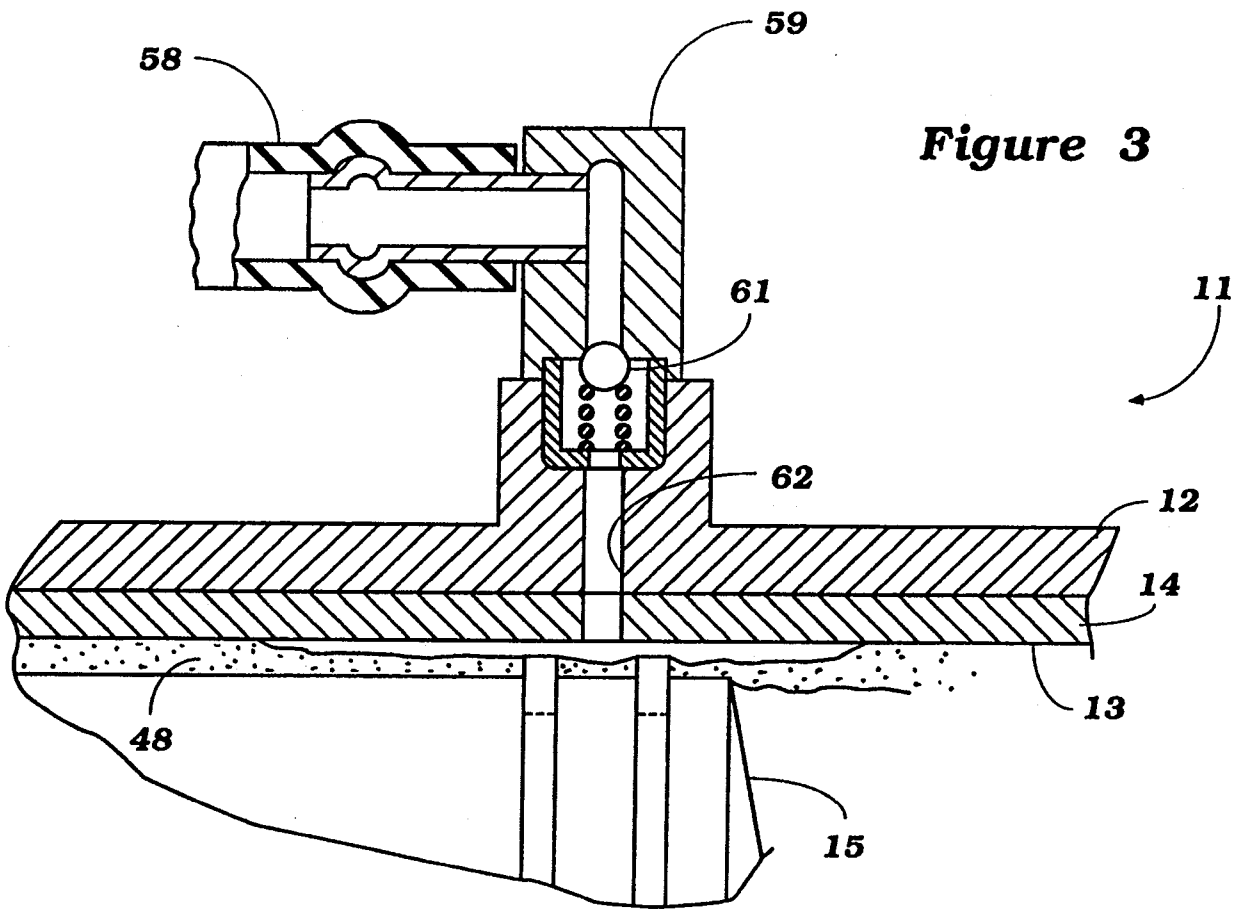
FIG. 3 is an enlarged view of the area encompassed by the circle 3 in FIG. 2 and shows how the lubricant viscosity can affect the performance of the engine.

As may be seen in FIG. 3, a body of lubricant 48 will accumulate during the operation of the engine between the cylinder bore 13 and the outer periphery of the piston 15. This lubricant reduces friction and wear on the engine, as is well known. However, if the engine 11 is shut off and has been maintained at a high temperature, the residual lubricant 48 may in fact partially carbonize. In addition, combustion products in the combustion chamber 34 may also mixed with the lubricant 48 and increase its viscosity. This increased viscosity can give rise to high starting loads which, in turn, can reduce the cranking speed and give rise to difficulty in starting. An arrangement now to be described is provided for insuring against such starting difficulties.

The engine 11 is provided with a suitable electric starter (not shown) which is controlled by a suitable electric starting circuit. As is well known, this type of electric starter normally includes a pinion gear which is adapted to engage a ring gear on the flywheel of the engine 11 for cranking the crankshaft 12 during the starting operation. Since such structures are conventional, they have not been illustrated and it is believed that those skilled in the art will readily understand how such devices operate.

In accordance with the invention, an arrangement is incorporated for pumping a low viscosity fluid to the cylinder bore 13 under starting conditions when the temperature is below a predetermined amount. In the illustrated embodiment, this low viscosity fluid is fuel from the fuel tank 36. To this end there is provided with a pump arrangement, indicated generally by the reference numeral 49 which includes a pumping chamber 51 and a driving chamber 52 which are separated by a diaphragm 53. The driving chamber 52 is in communication with a respective one of the crankcase chamber 22 through a port 54 so that as the pressure in the crankcase chamber 22 fluxuates during engine operation, particularly during cranking, the diagram 53 will expand and contract the volume of the pumping chamber 51. A coil compression spring 54 is contained with the pumping chamber 51 and normally urges the diaphragm 53 to the position show in FIG. 1.

A fuel supply line 55 interconnects the fuel tank 36 with the pumping chamber 51. A delivery type of check valve 56 will open when the pumping chamber 51 increases its volume to permit flow into the pumping chamber 51, but will close when the pumping chamber 51 has its volume reduced. A discharge check valve 57 permits flow from the pumping chamber 51 into a supply conduit 58 which, in turn, supplies a low viscosity fluid fitting 59 mounted in the cylinder block 12 in proximity to each cylinder bore 13. As may be seen in FIG. 3, the low viscosity delivery fitting 59 includes a ball type check valve assembly 61 which controls the communication with a delivery port 62 that extends through the cylinder block 12 and cylinder liner 14 and opens into the cylinder bore 13 in an area swept by the piston 15. Hence, when fluid is discharged through the conduit 58 the check valve 61 will open and low viscosity fluid can mix with the higher viscosity lubricant 48. However, when the piston 15 opens the port 61, the check valve 61 will close and preclude any loss of compression through this circuit.

An electrically controlled valve 63 is provided in the discharge circuit of the pump 49 to the conduit 58 and opens and closes the communication of the pumping chamber 51 with the conduit 58. The electrically controlled valve 63 is controlled by an ECU 64 in a manner to be described.

The ECU 64 receives certain signals indicative of engine operation including a signal from a device 65 which indicates when the starter is being operated. The device 65 may constitute nothing more than a lead from one of the starter terminals of the engine. In addition, the engine 11 is provided with a crank position sensor 66 which outputs signals for the firing of the spark plugs 42 and operation of the fuel injector 35 and also provided a signal indicative of speed. Engine temperature is sensed by a sensor 67 which is mounted in the cylinder head 33 in proximity to its cooling jacket 47 and which outputs a signal to the ECU 64.

Figure 4:
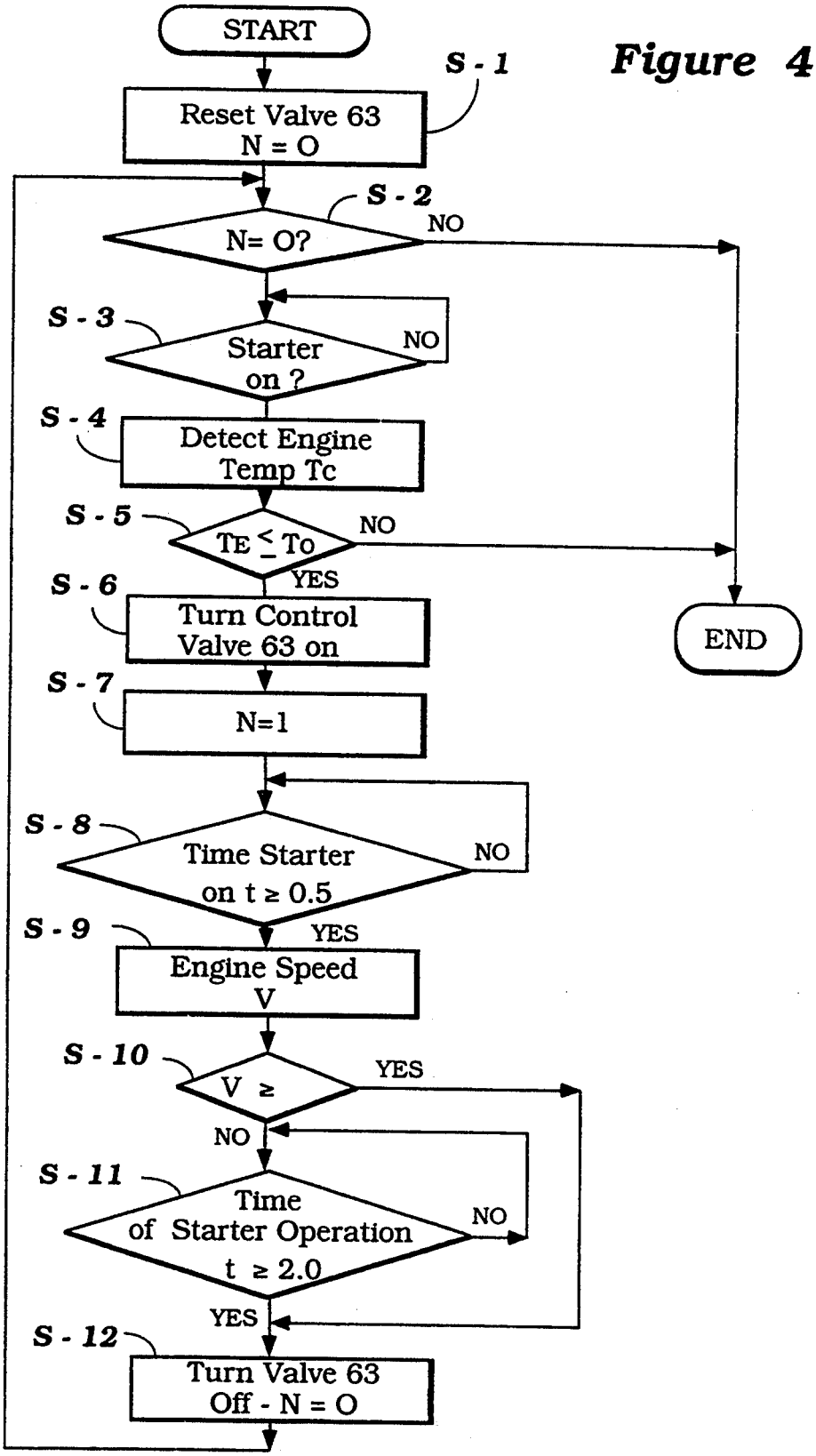
FIG. 4 is a block diagram showing a control routine operating in accordance with an embodiment of the invention for facilitating starting.

The control routine will now be described by particular reference to FIG. 4. Basically, the control routine operates so as to sense when engine starting is being accomplished and the temperature of the engine 11 is such that the lubricant remaining in the cylinder walls 13 may provide an added drag against starting of the engine 11 that .could adversely affect the operation of the starter motor. When this occurs, low viscosity fluid such as the fuel is supplied through the system previously described by opening of the control valve 63 by the ECU 64. This control routine will now be described by reference to FIG. 4.

When the program starts, it moves to the step S-1 so as to reset the condition of the low viscosity fluid delivery valve 63 to its off condition (N=0) so as to close the valve 63 and preclude the delivery of low viscosity fluid to the engine port 62. The program then moves to the step S-2 to determine the condition of the valve 63. If at the step S-2 it is indicated that the valve 63 is in its off or 0 condition, the program moves to the step S-3 as will be described. If, however, the valve 63 is not in its off condition, the program will then end.

If at the step S-2 it is determined that the control valve 63 is off (0 condition), the program then moves to the step S-3 to determine if the starter is being operated. If the starter is not being operated, the program repeats back to the step S-3.

If, however, at the step S-3 it is determined that the starter is being operated, the program then moves to the step S-4 to determine the engine temperature $T_E$ as detected by the temperature sensor 67. The program then moves to the step S-5 to compare the engine temperature $T_E$ with a predetermined engine temperature $T_O$, which temperature is determined as a temperature low enough where there may be starting problems due to the viscosity of the retained lubricant in the engine. If the temperature is not below the temperature $T_O$, the program ends.

If, however, at the step S-5 it is determined that the temperature $T_E \leqq$ the temperature $T_O$, the program then moves to the step S-6 so as to switch the state of the control valve 63 to turn it on (1). This is done at the step S-7 by changing the state of the control valve 63 from 0 to 1.

When the control valve 63 is turned on, the pump 49 will deliver fuel to the fitting 59 and engine cylinder bore 13 through the port 62 so as to reduce the viscosity of the fluid trapped between the piston 15 and cylinder bore 13.

The program then moves to the step S-8 wherein the ECU 64 determines the length of time at which the starter has been on. If the time is less than one half of a second, the program repeats. If, however, the starter has been operated for one half second or more, the program then moves to the step S-9 to detect the engine speed V. The program then moves to the step S-10 to determine if the actual engine speed $V \geqq$ a predetermined minimum engine speed $V_O$ at the step S-10. This is done to determine if the engine is cranking at a speed which is greater than the undesired low cranking speed. If the engine speed of cranking is $\geqq$ the speed $V_O$, the program skips to the step S-12 where the valve 63 is again turned off by returning it to its 0 state as further viscosity decrease is not required and is in fact undesirable.

If, however, at the step S-10 it has been determined that the engine cranking speed is still below the predetermined minimum speed, the program moves to the step S-11 to continue to supply low viscosity fluid until a predetermined time period, such as 2 seconds has elapsed, assuming that the starter motor is still be operated. If the time is less than 2 seconds, the program repeats back to the step S-11. On the other hand, if there have been 2 seconds of delivery of low viscosity fluid, then the program times out by going to the step S-12 to turn off the valve 63 as it will have been determined that adequate low viscosity fluid has been added to the engine.

Figure 5:
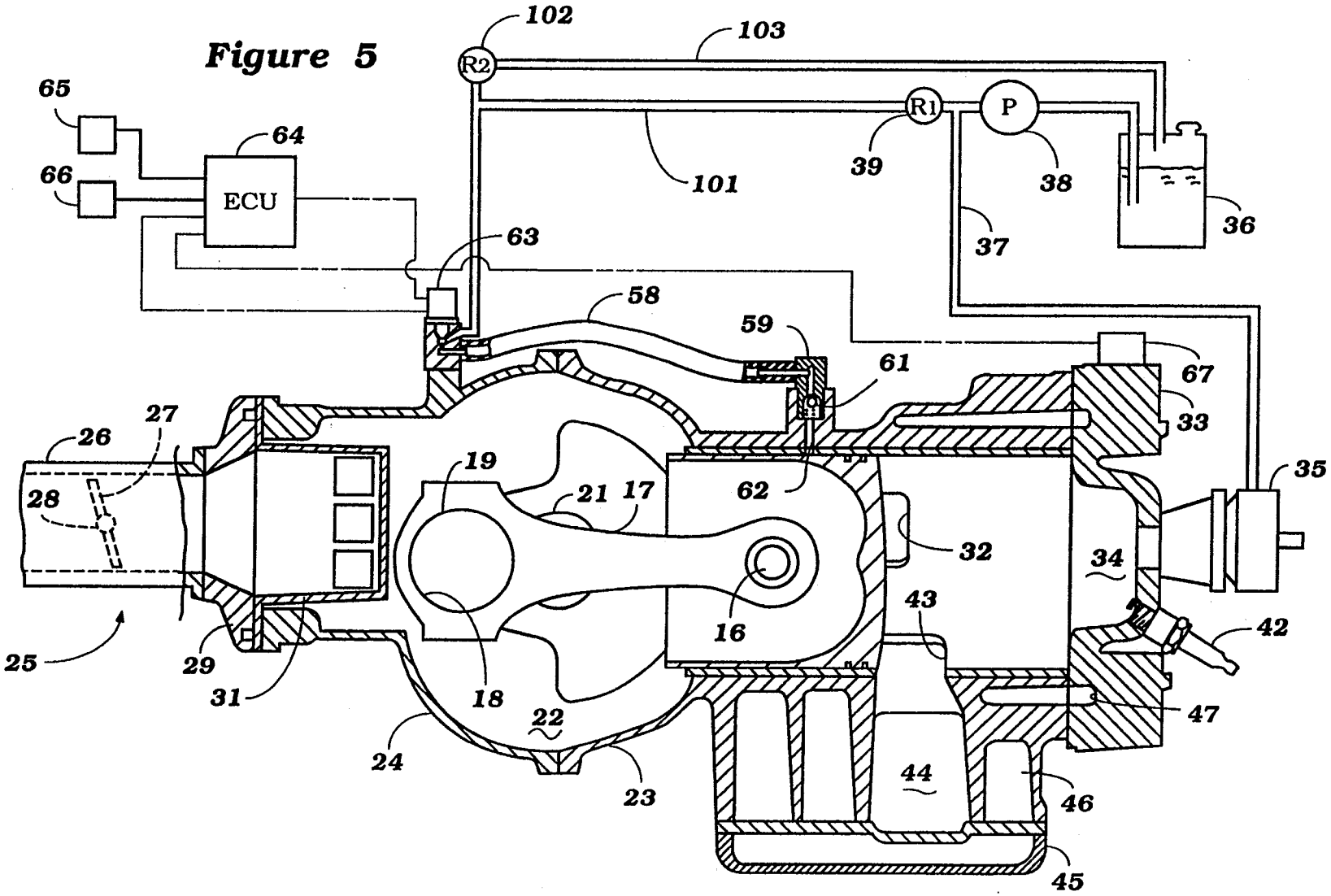
FIG. 5 is a cross sectional view, in part similar to FIG. 1, and shows another embodiment of the invention.

FIG. 5 shows another embodiment of the engine which is generally the same as the embodiment of FIGS. 1 through 4 and, for that reason, components of this embodiment which are the same as those previously described have been identified by the same reference numerals and will not be described again in detail. In this embodiment, the separate low viscosity fluid pump 49 is eliminated. In this embodiment, a line 101 interconnects the pressure regulator 39 which regulates the pressure of fuel supplied to the fuel injector 35 to the valve 63 and to a second pressure regulator 102. The regulator 102 regulates pressure at a substantially lower pressure than that supplied to the fuel injector 35 and bypasses excess fuel back to the fuel tank 36 through a return line 103. This lower pressure regulated fuel is supplied to the valve 63 and, accordingly, to the port 61 when the valve 63 is opened for reducing the viscosity of the fluid on the cylinder bores 13 during starting. In all other regards, this embodiment is the same as that previously described and, for that reason, further description is not believed to be necessary.

It should be readily apparent from the foregoing description, that the described embodiments of the invention are extremely effective in providing ease of starting of an engine by supplying low viscosity fluid to the cylinder walls at times when high drag might be present. Of course, the described embodiments are preferred embodiments of the invention and various changes and modifications may be made without departing from the spirit and scope of the invention, as defined by the appended claims.

We claim:

1. A system for facilitating the starting of an internal combustion engine comprised of a cylinder bore, a piston reciprocating in said cylinder bore, a port communicating with said cylinder bore in an area swept by said piston, a starter for starting said engine, a temperature sensor for sensing temperature, a lubricating system for supplying lubricant to said engine including the sliding surfaces of said piston and said cylinder bore, a charge former for supplying a fuel air charge to said engine for combustion during starting and running, and means for supplying a fluid less viscous than the lubricant supplied by said lubricating system to said port only upon the starting of said engine for reducing the viscosity between said cylinder bore and said piston when the temperature sensed is below a predetermined value.

2. A system for facilitating the starting of an internal combustion engine as set forth in claim 1 wherein the low viscosity fluid is supplied for only a limited time during the starting operation.

3. A system for facilitating the starting of an internal combustion engine as set forth in claim 1 wherein the low viscosity fluid is supplied only if the speed of the engine during starting is below a predetermined speed.

4. A system for facilitating the starting of an internal combustion engine as set forth in claim 3 wherein the low viscosity fluid is supplied for only a limited time during the starting operation.

5. A system for facilitating the starting of an internal combustion engine as set forth in claim 1 wherein the engine is a crankcase compression, internal combustion engine and includes a crankcase chamber and a scavenge passage connecting said crankcase chamber with said cylinder bore.

6. A system for facilitating the starting of an internal combustion engine as set forth in claim 5 wherein the low viscosity fluid is supplied for only a limited time during the starting operation.

7. A system for facilitating the starting of an internal combustion engine as set forth in claim 5 wherein the low viscosity fluid is supplied only if the speed of the engine during starting is below a predetermined speed.

8. A system for facilitating the starting of an internal combustion engine as set forth in claim 7 wherein the low viscosity fluid is supplied for only a limited time during the starting operation.

9. A system for facilitating the starting of an internal combustion engine as set forth in claim 5 wherein the low viscosity fluid is fuel not supplied to the charge former.

10. A system for facilitating the starting of an internal combustion engine as set forth in claim 9 wherein the fuel is pumped by variations in the crankcase pressure.

11. A system for facilitating the starting of an internal combustion engine as set forth in claim 10 further including electrically controlled valve means for controlling the supply of the fuel to the port.

12. A system for facilitating the starting of an internal combustion engine as set forth in claim 11 further including check valve means in the port for permitting fuel to flow under pressure to the port but precluding flow back through the port.

13. A method for facilitating the starting of an internal combustion engine comprised of a cylinder bore, a piston reciprocating in said cylinder bore, a port communicating with said cylinder bore in an area swept by said piston, a starter for starting said engine, a temperature sensor for sensing temperature, a lubricating system for supplying lubricant to said engine including the sliding surfaces of said piston and said cylinder bore, a charge former for supplying a fuel air charge to said engine for combustion during starting and running, said method comprising the steps of supplying a fluid less viscous than the lubricant supplied by said lubricating system to the port upon the starting of said engine for reducing the viscosity between the piston and cylinder bore and when the temperature sensed is below a predetermined value.

14. A method for facilitating the starting of an internal combustion engine as set forth in claim 13 wherein the low viscosity fluid is supplied for only a limited time during the starting operation.

15. A method for facilitating the starting of an internal combustion engine as set forth in claim 13 wherein the low viscosity fluid is supplied only if the speed of the engine during starting is below a predetermined speed.

16. A method for facilitating the starting of an internal combustion engine as set forth in claim 15 wherein the low viscosity fluid is supplied for only a limited time during the starting operation.

17. A method for facilitating the starting of an internal combustion engine as set forth in claim 13 wherein the engine is a crankcase compression, internal combustion engine and includes a crankcase chamber and a scavenge passage connecting said crankcase chamber with said cylinder bore.

18. A method for facilitating the starting of an internal combustion engine as set forth in claim 17 wherein the low viscosity fluid is supplied for only a limited time during the starting operation.

19. A method for facilitating the starting of an internal combustion engine as set forth in claim 17 wherein the low viscosity fluid is supplied only if the speed of the engine during starting is below a predetermined speed.

20. A method for facilitating the starting of an internal combustion engine as set forth in claim 19 wherein the low viscosity fluid is supplied for only a limited time during the starting operation.

21. A method for facilitating the starting of an internal combustion engine as set forth in claim 17 wherein the low viscosity fluid is fuel not supplied to the charger former.

22. A method for facilitating the starting of an internal combustion engine as set forth in claim 21 wherein the fuel is pumped by variations in the crankcase pressure.

23. A method for facilitating the starting of an internal combustion engine as set forth in claim 22 further including controlling the supply of the fuel to the port by an electrically opeated valve.

24. A method for facilitating the starting of an internal combustion engine as set forth in claim 23 further including permitting fuel to flow under pressure to the port but precluding flow back through the port.

* * * * *